US009925475B2

(12) United States Patent
Sweed

(10) Patent No.: US 9,925,475 B2
(45) Date of Patent: Mar. 27, 2018

(54) WIND CHIMES WITH BUBBLE PRODUCING MEANS

(71) Applicant: James Ray Sweed, Houston, TX (US)

(72) Inventor: James Ray Sweed, Houston, TX (US)

( * ) Notice: Subject to any disclaimer, the term of this patent is extended or adjusted under 35 U.S.C. 154(b) by 0 days.

(21) Appl. No.: 14/732,730

(22) Filed: Jun. 7, 2015

(65) Prior Publication Data

US 2016/0354708 A1 Dec. 8, 2016

(51) Int. Cl.

| | |
|---|---|
| ***A63H 33/28*** | (2006.01) |
| ***A63H 33/40*** | (2006.01) |
| ***G10K 1/07*** | (2006.01) |
| ***G10K 1/26*** | (2006.01) |

(52) U.S. Cl.

CPC ..... *A63H 33/28* (2013.01); *A63H 33/40* (2013.01); *G10K 1/07* (2013.01); *G10K 1/26* (2013.01)

(58) Field of Classification Search

CPC ..... A63H 33/28; A63H 33/40; G10K 1/00; G10K 1/07

See application file for complete search history.

(56) References Cited

U.S. PATENT DOCUMENTS 2,862,320 A * 12/1958 Mayo ..... A63H 33/28 40/408
D185,805 S * 8/1959 Clark ..... 446/16
4,071,216 A * 1/1978 Einhorn ..... A47B 96/061 248/282.1
4,758,197 A * 7/1988 Lee ..... A63H 5/00 446/213
4,872,387 A * 10/1989 Melia ..... G10F 1/06 84/95.2
5,040,491 A * 8/1991 Yancy ..... A01K 39/014 119/533
5,342,869 A * 8/1994 Stoll ..... C07F 9/4021 524/117
5,385,472 A * 1/1995 Mullin ..... G09B 23/12 434/126
5,540,608 A * 7/1996 Goldfarb ..... A63H 5/00 446/15
5,647,298 A * 7/1997 Yancy ..... A01K 39/014 119/57.8
5,648,624 A * 7/1997 Smith ..... G10K 1/072 116/141
6,015,327 A * 1/2000 Kovacs ..... A63H 33/28 446/15

(Continued)

FOREIGN PATENT DOCUMENTS

DE 29606571 U1 * 6/1996 ..... A63H 33/28
JP 2009276408 A * 11/2009

*Primary Examiner* — Gene Kim
*Assistant Examiner* — Alyssa Hylinski

(57) ABSTRACT

A wind chime assembly with traditional chiming functions actuated by outside wind currents knocking a striker into an array of metal pipes but additionally incorporating bubble making acquisition through a coupling of a bubble making apparatus with integrated wind vanes joined to a plurality of bubble producing apertures rotatablely dipped into a supply of contained bubble solution to simultaneously manifest a flotilla of entrancing bubbles drifting airily about to the soothing tones of the wind chimes actuated by the same outside wind currents. Disengagement of the primary components also allow for each be operated separately.

17 Claims, 9 Drawing Sheets

(56) References Cited

U.S. PATENT DOCUMENTS

| | | | | |
|---|---|---|---|---|
| 6,604,691 | B1 * | 8/2003 | Thomas | B05B 3/06 239/273 |
| 7,749,044 | B1 * | 7/2010 | Herglotz | A63H 5/00 446/213 |
| 8,421,252 | B1 * | 4/2013 | Kuelbs | F03G 6/001 290/1 R |
| 2003/0092352 | A1 * | 5/2003 | Collier | A63H 33/40 446/48 |
| 2007/0019404 | A1 * | 1/2007 | Chen | F21S 9/037 362/192 |
| 2011/0081821 | A1 * | 4/2011 | Temiz | A63H 33/28 446/16 |

* cited by examiner

WIND CHIMES WITH BUBBLE PRODUCING MEANS

BACKGROUND

Field of the Invention

This invention relates to wind chimes and more particularly to wind chimes being adapted with bubble producing means.

Description of Prior Art

Bubble producing devices often take the form of toys primarily for the amusement of children. However their iridescent quality and myriad shapes fascinate and entertain both old and young alike. Wind chimes are used mainly to adorn areas of the patio or garden and provide pleasing sounds to those relaxing there. To date these items have been separately constructed.

Wind chimes have been enjoyed by people throughout the world from one generation to the next for centuries. While various types of wind chimes have incorporate noble and innovative features, I'm not aware of any such device incorporating bubble generating apparatus.

U.S. Pat. No. 6,124,782 disclose a highly technical wind chime assembly which electronically produces an audio effect such as birds, rain, music, etc. in addition to the usual musical chiming; however electronics can be prohibitively expensive to manufacture and problematic when left outside expose to the elements over time.

But on the other hand, a rather simple innovation in the wind chime category is proposed in U.S. Pat. No. 7,485,788 where there are message bars placed among the chimes imprinted with faith building words. A clever feature, but the average person will be unaccustomed and inconvenienced to read words from wind chimes moving about in brisk winds.

U.S. Pat. No. 7,518,253 B2 features a solar powered wind chime apparatus having a rechargeable electrical power source that is recharged by the solar energy system. The draw back to this idea is the ever changing weather. There can be many days when there will be obstruction to the solar energy source.

While these innovations in wind chimes range from the simple to the sophisticated, none however contemplate a contrivance of chimes and bubbles making mechanisms in a single interconnected assembly. A bubble producing wind chime apparatus is both clever and innovative and would be a cherished addition to those that value the neoteric in this genre. I therefore conclude a functional bubble producing wind chime apparatus is both producible and would be highly desirable.

SUMMARY OF THE PRESENT INVENTION

The present invention relates to a wind chime assembly constructed and operated in the traditional since but is interconnected with a bubble producing apparatus assembled as a single device to both chime and expel bubbles simultaneously when actuated by the same outside air currents. The present invention primary components can be disengaged and operated independently as well.

It is the object of the present invention to provide the pleasing sound of wind chimes and the visual amusement of bubbles paired in a single apparatus.

It is also an object of the present invention to provide a wind chime assembly and bubble producing apparatus which can be operated as separate devices.

It is another object of the present invention to provide a wind chime bubble blower apparatus with means to orient into the wind and lock in generally a stable position.

Another object of the present invention is to provide a wind chime bubble blower apparatus that is aesthetically pleasing.

It is still a further object and advantage of the present invention to provide a wind chime bubble blower which is easy to manufacture, easy to install, and relatively inexpensive.

It is another object of the invention to successfully adapt wind chimes as a functional bubble producing apparatus.

The primary object of the present invention is the provision of wind chimes adapted with bubble producing apparatus to simultaneously produce pleasing melodic tunes with the playful hypnotic sight of drafting bubbles dancing in the wind.

These and other objects and features of the present invention would be better understood in view of the descriptions below, made in connection with the following drawings.

DESCRIPTION OF THE PREFERRED EMBODIMENT

Figure 1:
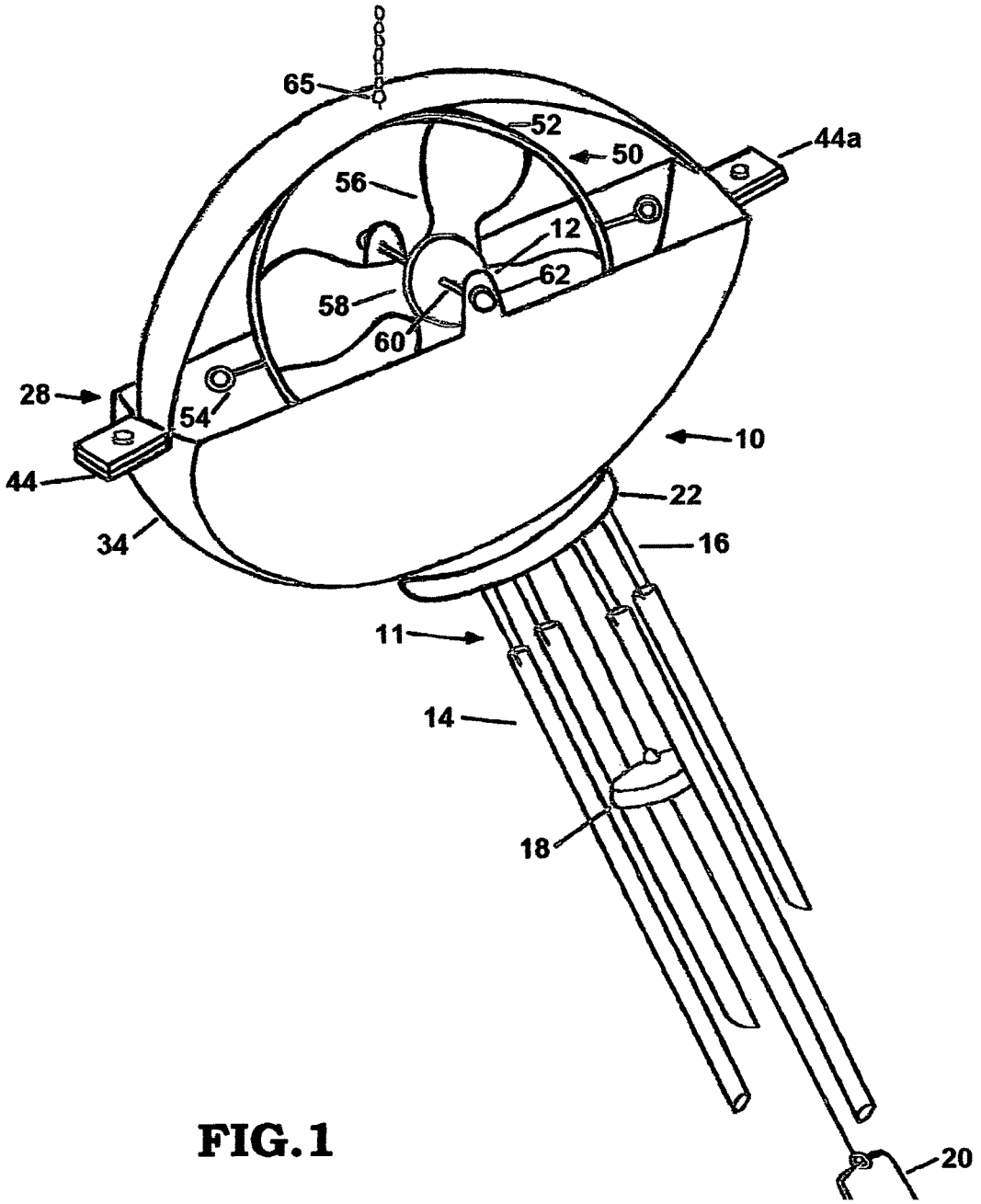
FIG. 1 is an isometric view of the wind chime bubble blower apparatus of the present invention.

In referring to the drawing of FIG. 1, a wind chime bubble blower apparatus 10 having an assembly of wind chimes 11 integrally hinged to a bubble producing mechanism 28.

Wind chimes 14 of the preferred embodiment are a plurality of elongated metal tubes suspended with a plurality of cords 16 or similar material. A clapper 18 and a pendulum 20 are suspended vertically from similar cord 16 material centrally hung among said wind chimes. When the pendulum 20 is moved about in the outdoor wind currents, it cause the clapper 18 to strike against the wind chimes 14 producing musical tones.

Figure 6:
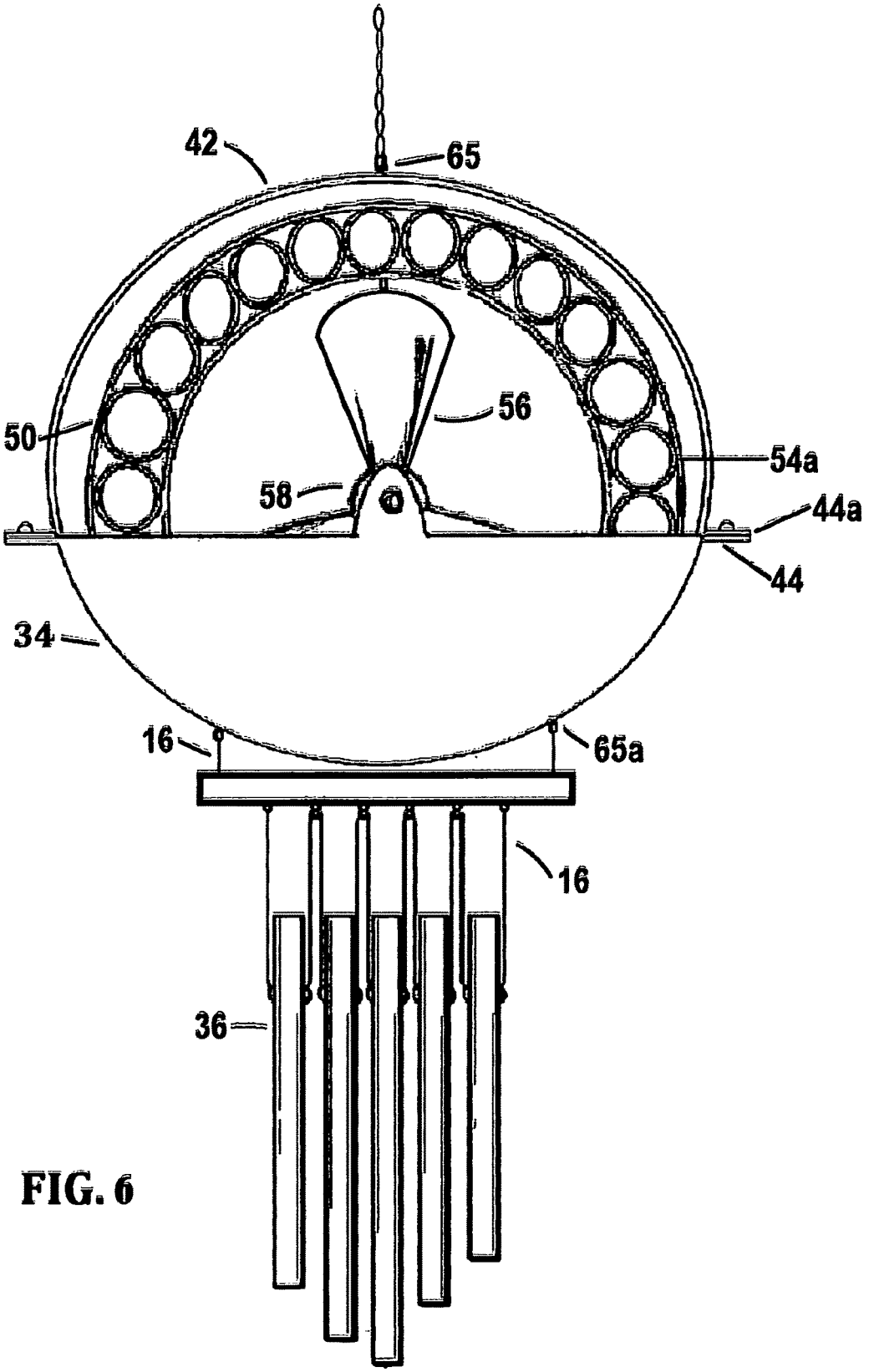
FIG. 6 features a rim wheel component with a contiguous inner array of bubble forming rings encircling wind vane elements with wind chimes in a substantially lateral arrangement.
Figure 9:
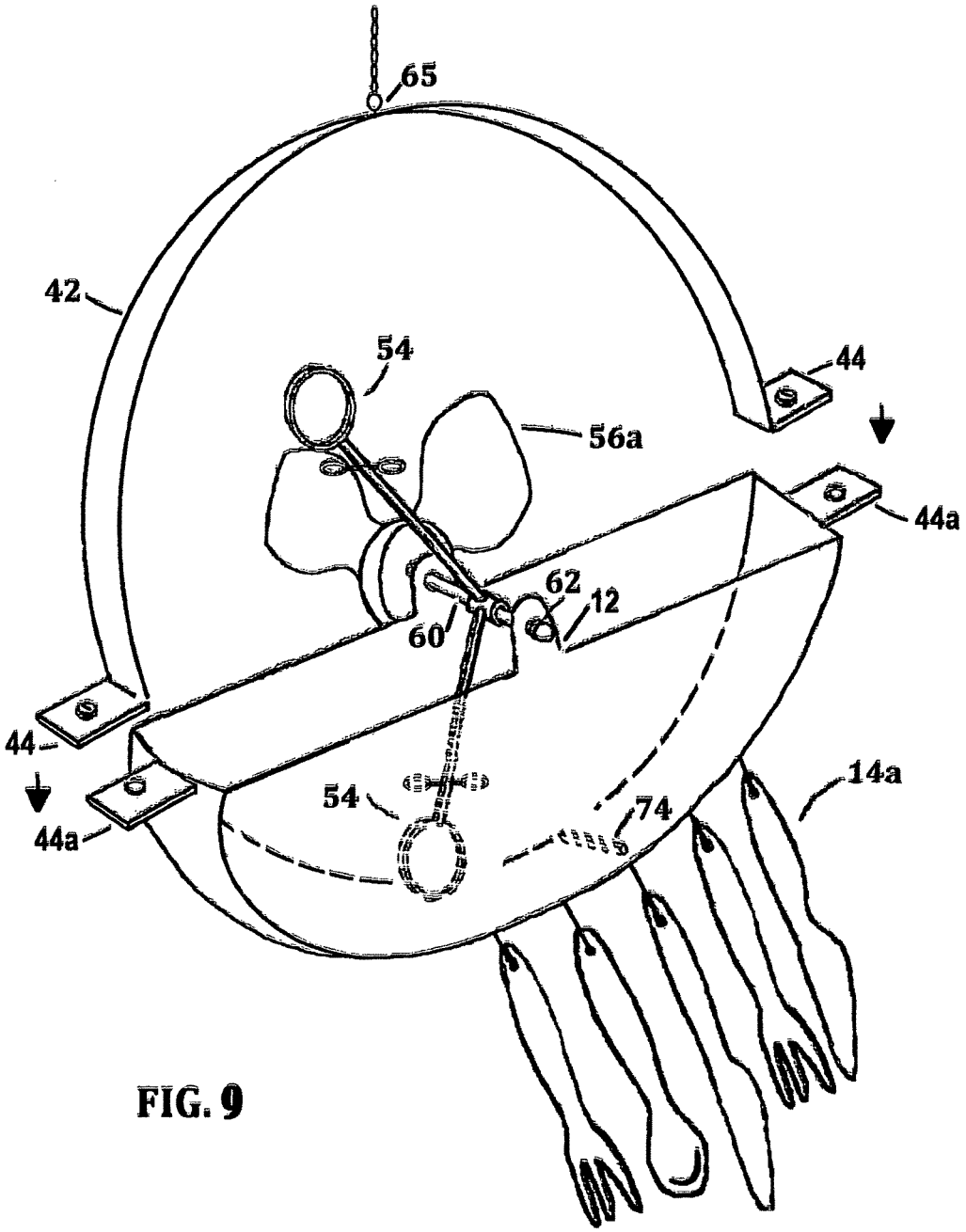
FIG. 9 embodiment presents an unconventional wind chime design and wherein the bubble wands make only partial turns in an oscillating to and fro fashion.

The present invention takes this general design as the preferred embodiment, that is, hollow tubes suspended equidistant from each other in primarily a circular arrangement around the clapper and pendulum. Other formations maybe used, such as a side by side alignment of the tubes as shown in FIG. 6, which feature chimes without clapper and pendulum. The wind chime element can also take on an extremely eccentric non-traditional design as shown in FIG. 9 alternate embodiment wherein kitchen utensils 14*a* are used instead of tubes for chimes.

Figure 2:
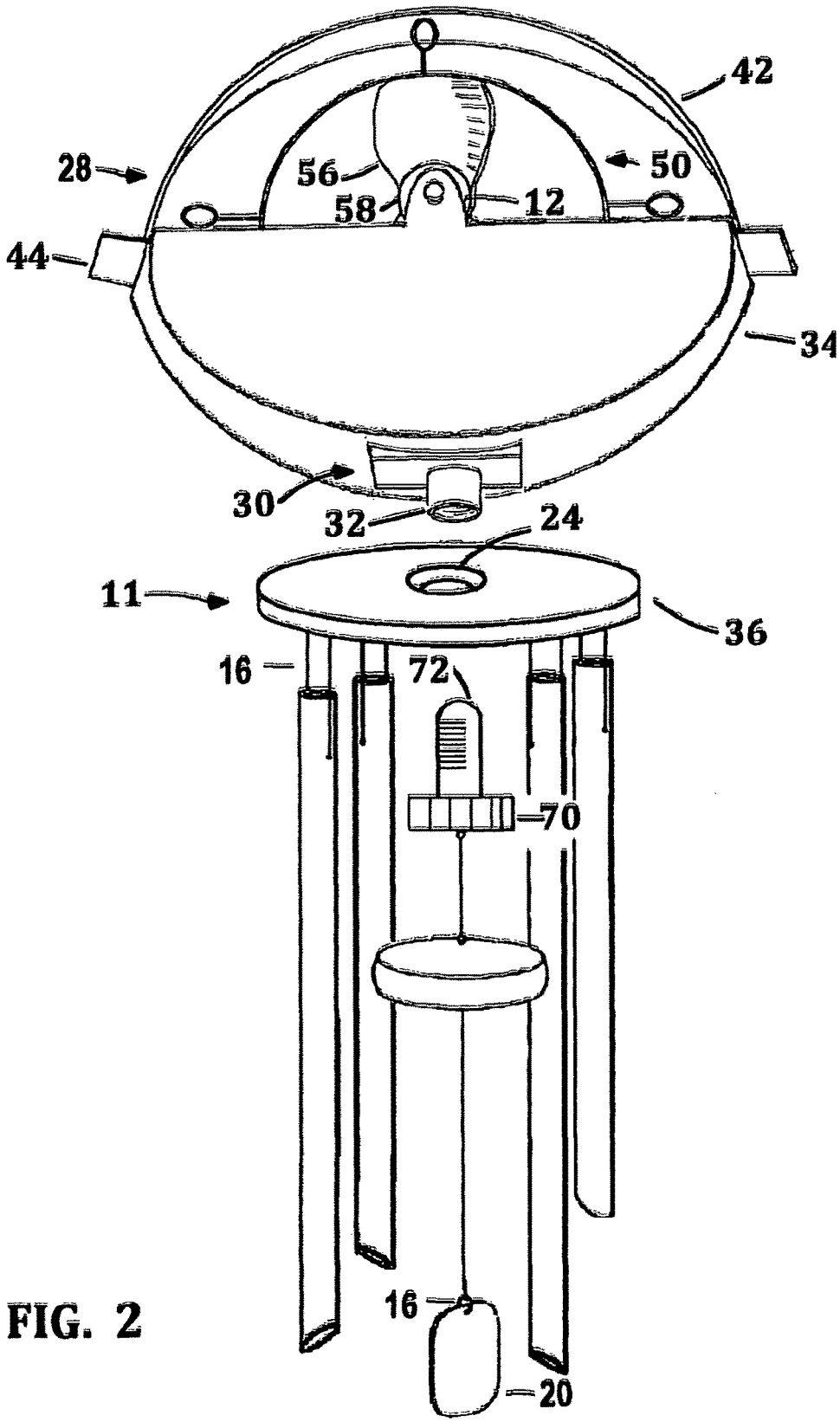
FIG. 2 is a schematic view of coupling components of the wind chime assembly of the present invention.
Figure 3:
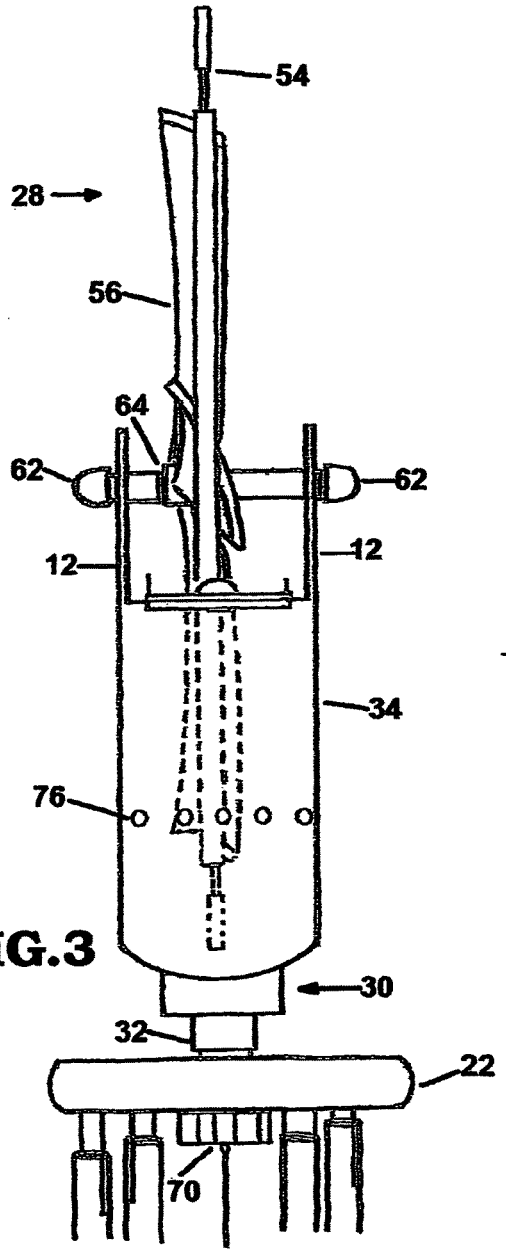
FIG. 3 is a side view of invention which present an array of drainage holes along one curvature wall of the bubble solution housing.
Figure 10:
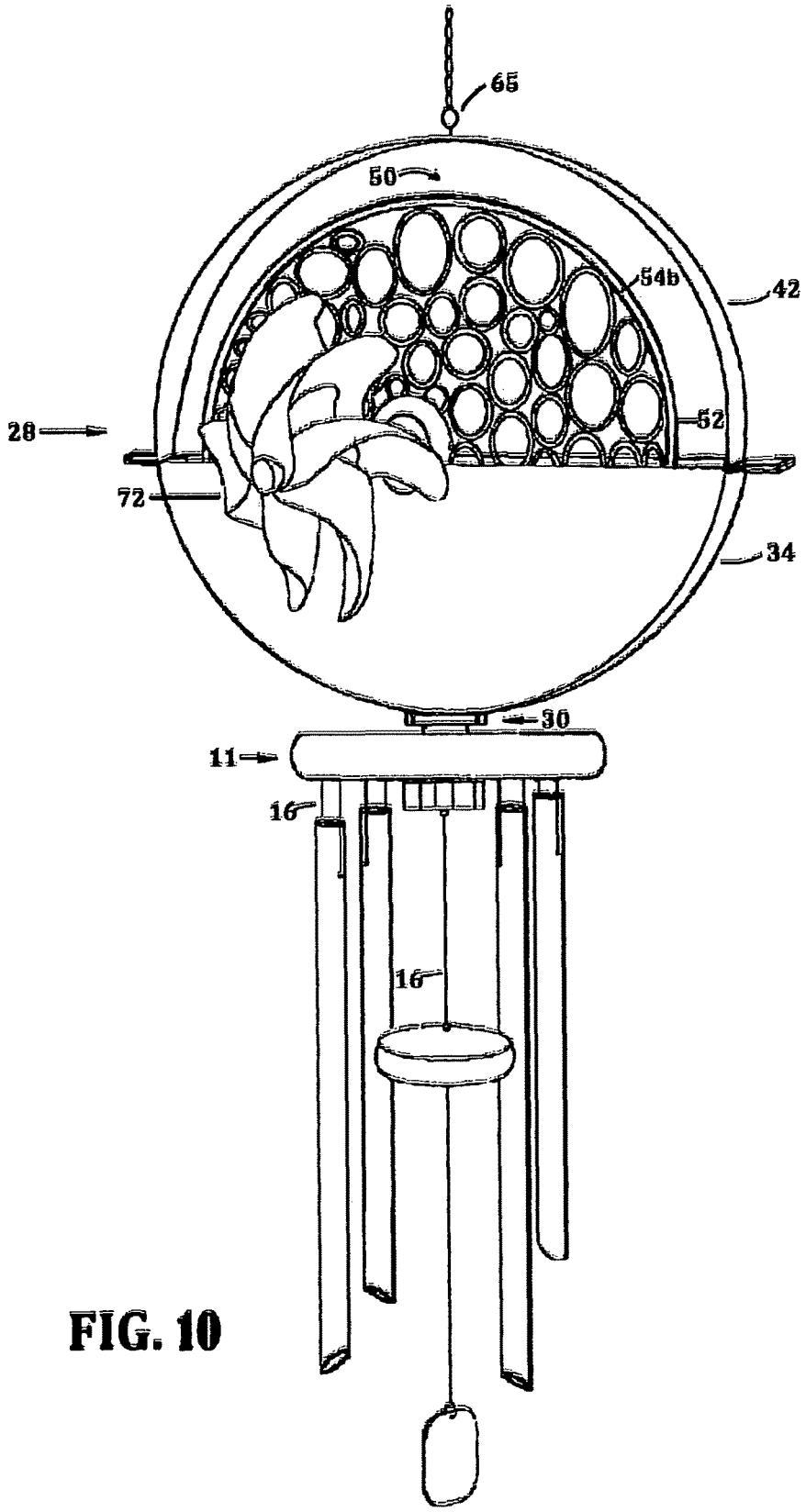
FIG. 10 perspective view illustrate an embodiment of the present invention wherein the vanes take the form a pinwheel modified to rotate the shaft with attached bubble disk.

A circular disk serves as a base 22 by which the cords 16 of the wind chime assembly 12 hang from as shown in FIG. 2. The base 22 has a central passageway 24 in the form of a small hole. Said passageway 24 allow a path for the interconnection between a large knurled head knob screw 70, the wind chime base 22, and a coupling element 30. An elongated cylindrical coupling hole 32 protrude vertically from coupling element engages a threaded shaft 72 of the large knurled head knob screw 70 in a screw like fashion. The large knurled head of the knob screw 70 effectively covers the passage way 24 of the wind chime base 22 when engaged into the coupling hole 32 of the coupling element 30 as shown in FIGS. 3 and 10. This coupling of the base 22 between the knob screw 70 and coupling element 30 creates a secure link and facilitate a bonding of the two systems.

As clearly illustrated in FIGS. 3 and 10, the coupling element 30 attaches wind chime assembly 11 to the bottom surface of a bubble solution housing unit 34. The coupling element 30 is sized and shaped in a curvature manner for efficient abutment underneath of bubble producing mechanism 28. Attachment of coupling element 30 can be achieved by adhesive bonding, screw on, and or manufactured integrally as part of the bubble solution housing.

The entire wind chime assembly 11 freely droops beneath the bubble producing mechanism 28.

The bubble solution housing 34 is where the bubble solution is contained to supply the covering film to generate bubbles. A number of intersperse bubble wands 54 like that of FIG. 1, or a plurality of bubble rings Ma like that of FIG. 6 and FIG. 10, are covered in a film of bubble solution to be exposed to the wind by means of rotational movement of the bubble making apertures.

FIG. 1 illustrates a pair of stilts 12, vertically extending upwards from broad side of planar walls which form the rectangular opening of the bubble solution housing 34. Suspended between orifices of stilts is a rim wheel frame work 50 on a shaft 60. This wind actuated frame work comprises of a circular rim 52, a disperse number of bubble wands 54 extending from the outer perimeter of rim 52, and a plurality of vanes 56 connected to rim radically about a hub 58, all being interconnected to the inner perimeter of the circular rim 52. The rim wheel framework 50 is rotatably mounted on shaft 60 between stilts 12 as to rotate bubble wands 54 into bubble solution housing 34 to make close proximity to bottom floor. The rim wheel with bubble wands 54 serves as a rotatable dipper submerging and emerging the apertures of the bubble wands into the bubble solution to capture a thin film of solution by which bubbles are formed when contacted by air currents.

Figure 4:
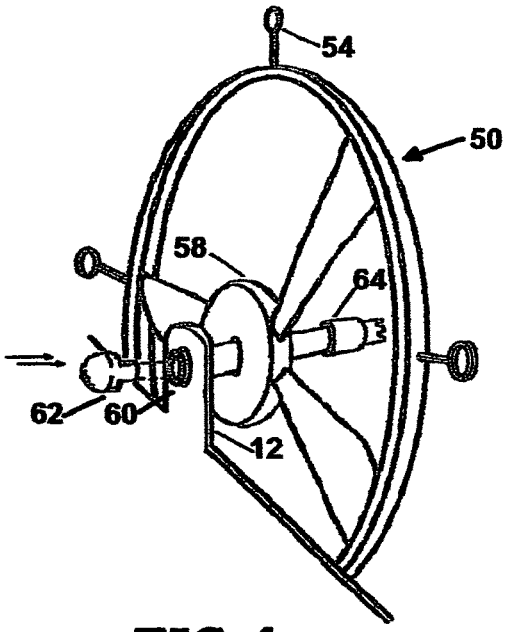
FIG. 4 is a partial view of connecting parts of the rotatable bubble producing component engage to the bubble solution housing of the present invention.

The stilts 12 of the planer walls are made of semi-stiff material or flexible plastic that can be flexed to allow the rotatable shaft 60 with the entire rim wheel framework 50 to be manipulated between each orifice for support therein. Shaft 60 is secured with plugs 62 recessed into hollow ends of shaft 60 to eliminate any possibility of shaft disengaging from supports as shown in FIGS. 3 and 4. Removal of plugs from shaft to disengage rim wheel framework 50 will allow easy cleaning of bubble solution housing 34.

As illustrated in FIG. 3, one side wall of bubble solution housing is perforated with a series of drain holes 76. These drain holes will drain excess fluids, such as exposure to rain, from housing above preferred level.

The shaft 60 component has a collar 64 element that frictionally links to hub 58 of conjoined vanes 56 in a snap fit fashion as shown in FIGS. 3 and 4. The vanes 56 are meant to function in much the same way as the blades of a pinwheel. The material of choice for vane elements is semi-flexible plastic having blunt edges. Since this rotatable free-wheeling framework 50 maybe driven at high speeds in strong winds, a material such as this is generally suitable for a safety point of view.

Horizontally protruding from opposite ends of the bubble solution housing 34 are a pair of flange elements 44 as shown in FIGS. 1 and 9. A handle 42 of a semi-circular design with a set corresponding flange elements 44*a* mate together with that of the bubble solution housing by any suitable means such as bonding, rivets, screws, etc. The sturdy semi-circular handle 42, with a centrally located eyelet 65, is of adequate strength to support the whole wind chime bubble producing mechanism 28 including a filled bubble solution receptacle. The handle 42 is sufficiently wide in radius so as not to impede circular rotation of the bubble producing apertures. The handle is a very efficient way to carry entire apparatus to desired location to be hung from central eyelet by chain, rope, or cord and will accommodate a wide range of vertical height positioning from most overhead support.

Figure 5:
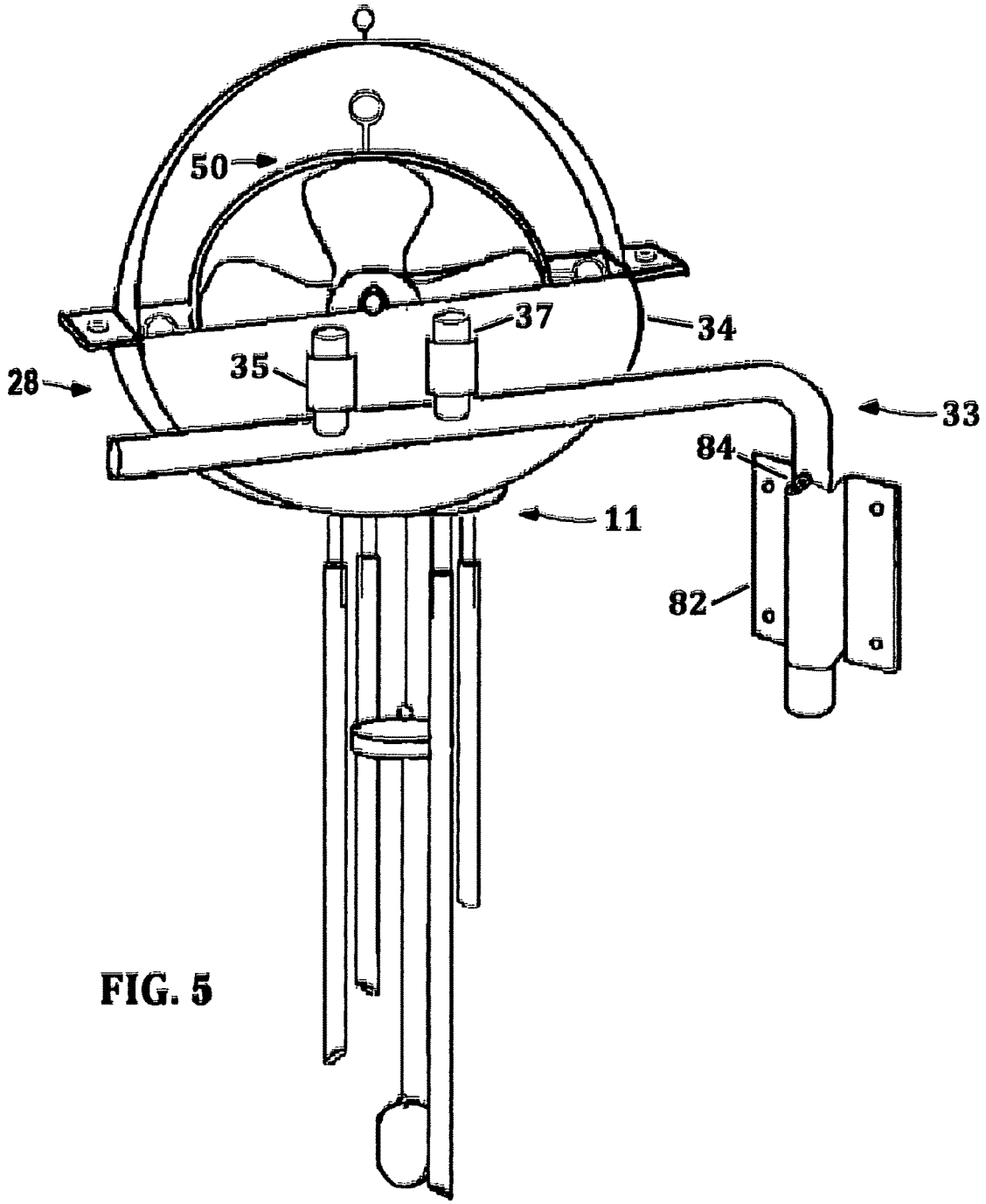
FIG. 5 is a view of the present invention held up on prongs of an elongated arm connected to a pivot and lock bracing device to permit stationary orientation into the wind.

In addition to handle with eyelet for means of suspension in use with rope, cord, chain etc., a pivot and lock brace device 33 as seen in FIG. 5 can also be effectively utilized to revolve and orient the entire wind chime bubble blower mechanism 28 into the wind. One exterior wall of the bubble solution housing 34 is equipped with a pair of sleeve-like support elements 35. These support elements 35 slidably connect with a pair of prongs 37 on an arm of the pivot and lock brace device 33. A bracket with slots 82 receives a pin 84 there through into a pinhole of arm element to lock revolving arm in position. The brace device can be attached to any suitable vertical support such as a post, column, or tree for example. The brace device 33 swivel and orient wind chime bubble blower mechanism 10 into the wind and lock it in a generally stable position even in brisk wind.

The embodiment illustrated in FIG. 6 shows a plurality of bubble rings Ma joined side by side to form a circular formation around the wind vanes 56 rotatablely connected to a hub disposed on a shaft. The wind chimes of FIG. 6 embodiment has a substantially lateral arrangement attached by cords to a rectangular base 21 and base tethered to bubble solution housing with cords tied to eyelets 65*a*.

Figure 7:
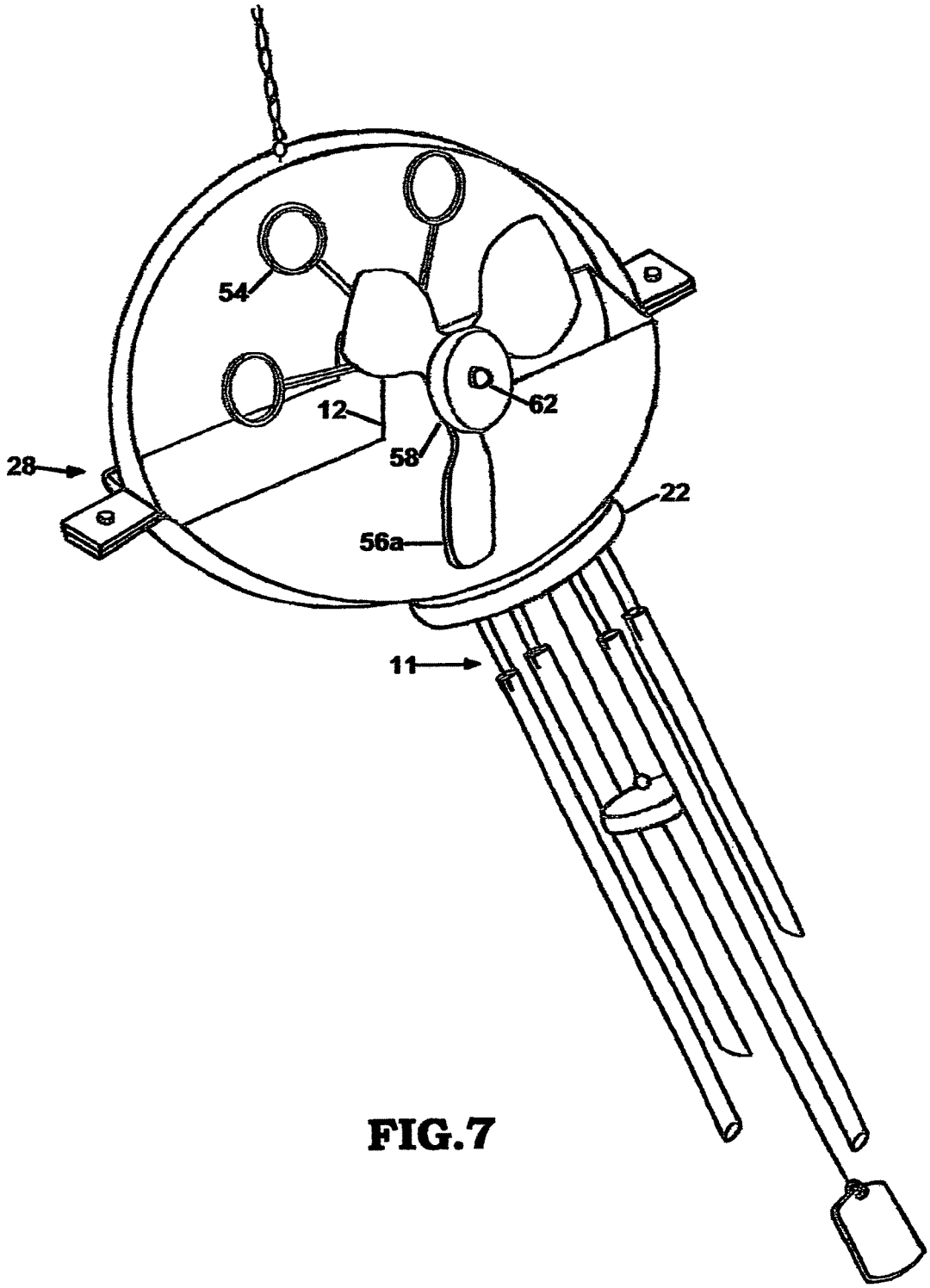
FIG. 7 illustrates a perspective view of an alternate embodiment of the present invention wherein the vanes operate outside one wall of the bubble solution housing.

The embodiment of FIG. 7 has the vanes 56*a* disposed outside the walls of the bubble solution housing 34 and rim wheel framework. Vanes function to rotate shaft connected bubble wands M or rings Ma into and out of bubble solution.

Figure 8:
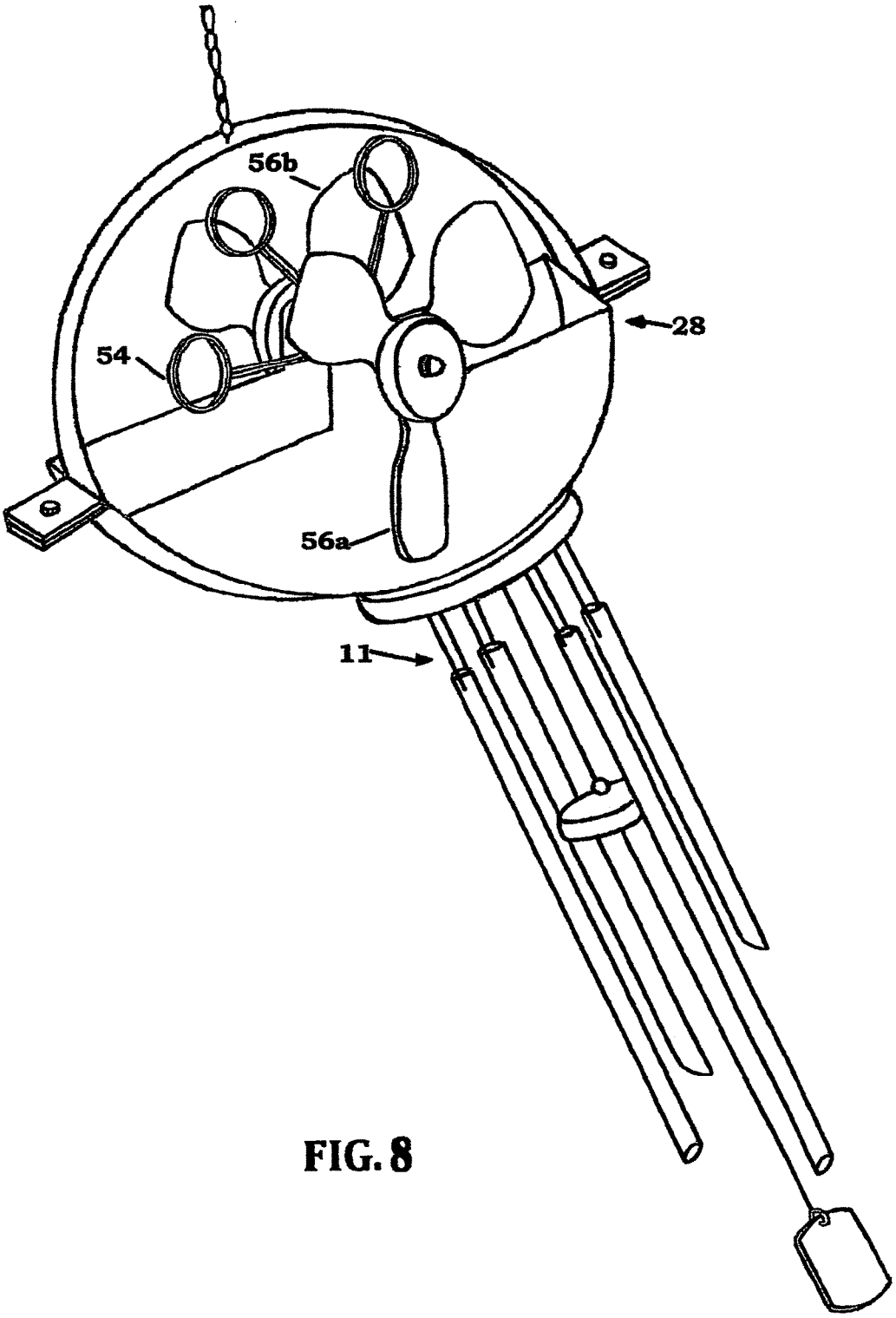
FIG. 8 alternate embodiment shows a pair of vanes one set on each end of a single shaft outside opposite walls of solution housing.

The embodiment of FIG. 8 is similar to that of FIG. 7 however, a pair of vanes 56*a* and 56*b* are Vanes work in unison to rotate bubble wands 54 through bubble solution.

FIG. 9 illustrate yet another embodiment of the present invention wherein the vanes make only partial turns of the shaft and connected bubble wands 54. A rotational stop 74 protrude from the bottom floor of bubble solution housing 34 to impede full rotation of bubble wands 54. This oscillating effect of the bubble wand will expose it intermittently longer to the air currents to prolong the materialization of bubbles.

FIG. 10 embodiment is similar that of FIG. 7 however the vanes are in the form of a pinwheel 72. The pinwheel is modified to embrace and rotate shaft with its bubble making orifices, which in this illustration take the form of a bubble disk 54*b*, into bubble solution. The bubble disk 54*b* is a correlation of a multitude of bubble rings of various diameters capable of producing an abundance of bubbles of assorted sizes.

Various modifications of the invention in addition to those shown and described herein this specification will become apparent to those skilled in the art from the foregoing description and accompanying drawings. Such modifications are intend to fall within the scope of the appended claims.

I claim:

1. An apparatus for concurrently producing bubbles and melodic tones comprising:

an assembly of chiming instruments for producing melodic tones having a base with a central clapper and pendulum surrounded by a plurality of elongated tubes suspended from the base by cords;

a rotatable bubble producing framework having vanes connected to a plurality of bubble making apertures;

a supply of bubble solution; and a pivot and lock brace for orienting and locking the apparatus in a stable position relative to a direction of a flow of air currents;

wherein, the bubble making apertures are suspended within dipping proximity of the supply of bubble solution for methodically picking up a thin film of said supply of bubble solution whereby exposing the assembly of chiming instruments and the bubble making apertures to the flow of air currents causes bubbles to be discharged from the bubble making apertures synchronously with the production of the melodic tones from the assembly of chiming instruments.

2. The apparatus of claim 1, wherein said supply of bubble solution is contained in a bubble solution housing component having walls and sleeve holding elements protruding from an outer wall of said bubble solution housing component for slideably connecting to prongs extending outward from an arm component of said pivot and lock brace.

3. The apparatus of claim 2, wherein the plurality of bubble making apertures are moveably suspended between the walls of said bubble solution housing component.

4. The apparatus of claim 3, wherein said bubble making apertures take the form of a dispersed number of radially extending bubble wands.

5. The apparatus of claim 3, wherein the plurality of bubble making apertures take the form of a disk having a multitude of ring apertures of different sizes for discharging a multitude of bubbles having different sizes.

6. The apparatus of claim 4, wherein the rotatable bubble producing framework is configured with said vanes and said dispersed number of bubble wands sharing a single common coaxial connection to a rotatable shaft attached to the bubble solution housing component whereby the flow of air currents causes the bubble wands to be submerged in and emerge from the supply of bubble solution in a reciprocating fashion.

7. The apparatus of claim 6, wherein the rotatable bubble producing framework is detachably secured between the walls of said bubble solution housing component to allow simultaneous removal of the vanes and dispersed number of bubble wands for thorough cleaning of the bubble solution housing component.

8. The apparatus of claim 7, wherein the bubble solution housing component has an array of drainage holes along one of the walls to expel excess fluid when the apparatus is exposed to rain thereby maintaining any fluid in the bubble solution housing component at a predetermined level.

9. The apparatus of claim 1, wherein in the rotatable bubble producing framework includes the bubble making apertures and a double set of vanes positioned on a common coaxial shaft for enabling the flow of air currents to be received from different directions producing a three-dimensional visual effect as the double set of vanes rotate in unison.

10. An apparatus for concurrently producing bubbles and melodic tones comprising:

an assembly of chiming instruments for producing melodic tones having a base with a central clapper and pendulum surrounded by a plurality of elongated tubes suspended from the base by cords;

a rotatable bubble producing framework having vanes in the form of a pinwheel connected to a plurality of bubble making apertures by a rotatable shaft; and a supply of bubble solution;

wherein, the bubble making apertures are suspended within dipping proximity of the supply of bubble solution for methodically picking up a thin film of said supply of bubble solution whereby exposing the assembly of chiming instruments and the bubble making apertures to a flow of air currents causes bubbles to be discharged from the bubble making apertures synchronously with the production of the melodic tones from the assembly of chiming instruments.

11. The apparatus of claim 10, wherein the plurality of bubble making apertures take the form of a disk having a multitude of ring apertures of different sizes attached to the rotatable shaft by a hub for discharging a multitude of bubbles having different sizes.

12. The apparatus of claim 10, wherein said bubble making apertures take the form of a dispersed number of radially extending bubble wands attached to the rotatable shaft by a hub.

13. The apparatus of claim 10, wherein the assembly of chiming instruments is detachable from the rotatable bubble producing framework for enabling independent operation of both the assembly of chiming instruments and rotatable bubble producing framework.

14. The apparatus of claim 10, further including a pivot and lock brace for orienting and locking the apparatus in a stable position relative to a direction of the flow of air currents and wherein said supply of bubble solution is contained in a bubble solution housing component having walls and sleeve holding elements protruding from an outer wall of said bubble solution housing component for slideably connecting to prongs extending outward from an arm component of said pivot and lock brace.

15. The apparatus of claim 13, further including a large knob screw for detachably connecting said assembly of chiming instruments and said rotatable bubble producing framework.

16. The apparatus of claim 14, wherein the base of the assembly of chiming instruments is connected to the bubble solution housing component by coupling, bonding, screwing or jointly manufacturing.

17. The apparatus of claim 12, further including a protrusion for hindering the rotation of the bubble making wands thereby limiting the movement of the bubble making wands to partial turns in an oscillating to and fro manner which exposes the bubble wands to the air currents longer prolonging the production of the bubbles.

* * * * *